US005580000A

United States Patent [19]

Kiuchi et al.

[11] Patent Number: 5,580,000

[45] Date of Patent: Dec. 3, 1996

[54] FUEL INJECTOR

[75] Inventors: Hideo Kiuchi, Hoi-Gun; Katsuhisa Shimokawa, Okazaki; Tatsuo Sakai, Kariya,; Yukihiro Sugiura, Anjo, all of Japan

[73] Assignee: Nippondenso Co., Ltd., Kariya, Japan

[21] Appl. No.: 276,493

[22] Filed: Jul. 18, 1994

Related U.S. Application Data

[63] Continuation of Ser. No. 18,238, Feb. 16, 1993, abandoned.

[30] Foreign Application Priority Data

Feb. 18, 1992 [JP] Japan ..... 4-030768

[51] Int. Cl.[6] ..... F02M 51/06

[52] U.S. Cl. ..... 239/533.12; 239/585.4

[58] Field of Search ..... 239/585.1, 585.4, 239/585.5, 533.11, 533.12, 584; 251/129.18

[56] References Cited

U.S. PATENT DOCUMENTS

| | | | |
|---|---|---|---|
| 3,368,761 | 2/1968 | Pelizzoni | 239/584 |
| 4,634,055 | 1/1987 | Hans et al. | 239/585.5 |
| 4,717,079 | 1/1988 | de Concini | 239/585.5 |
| 5,080,287 | 1/1992 | Takeda et al. . | |
| 5,110,053 | 5/1992 | Stevens | 239/533.12 |
| 5,161,743 | 11/1992 | Takeda et al. . | |

FOREIGN PATENT DOCUMENTS

| | | | |
|---|---|---|---|
| 861174 | 7/1941 | France . | |
| 3641469 | 6/1988 | Germany . | |
| 2163460 | 6/1990 | Japan . | |
| 0271065 | 11/1990 | Japan | 239/585.5 |
| 2123085 | 1/1984 | United Kingdom . | |
| 2215398 | 9/1989 | United Kingdom . | |

OTHER PUBLICATIONS

English abstract of Suzuki Japanese laid open Application No. 59–190470, Oct. 1984.

*Primary Examiner*—Andres Kashnikow
*Attorney, Agent, or Firm*—Cushman, Darby & Cushman

[57] ABSTRACT

A fuel injector comprises, a fuel flow adjustment throttle for determining a flow rate of a fuel passing through the fuel injector, a first member having a cylindrical surface for defining partially the fuel flow adjustment throttle, and a second member including a first surface and a second surface both of which extend toward the first member and join each other at a pointed edge defining the fuel flow adjustment throttle together with the cylindrical surface of the first member, and at least one of which forms a space expanding gradually in a fuel flow direction.

15 Claims, 5 Drawing Sheets

FUEL INJECTOR

This is a continuation of application Ser. No. 08/18,238, filed on Feb. 16, 1993, which was abandoned upon the filing hereof.

BACKGROUND OF THE INVENTION AND RELATED ART STATEMENT

The present invention relates to a fuel injector for supplying fuel to an engine.

Japanese Laid-Open Patent Publication No. 2-163460 discloses a known art in which-a fuel metering portion for metering the rate of injection is disposed in the fuel passage between a valve case upstream of an injection nozzle port and a valve member.

An example of the fuel metering portion is shown in FIG. 7. The fuel metering section 100 is adapted to meter the fuel by cooperation between the inner peripheral surface of the valve case 101 and an annular flange 103 provided on a valve member 102 so as to adjust the rate of injection of fuel. A plurality of metering surfaces 104 along which the fuel flows are provided in the outer peripheral surface of the flange 103.

In the conventional method of producing a fuel injector, the fuel metering portion 100 is formed by cutting the flange peripheral surface to form the metering surfaces 104 so as to increase the area of the flow passage. These metering surfaces 104 are formed to extend in parallel with the axis of the valve member 102.

To obtain the desired fuel injection rate, measurement of the fuel injection rate and cutting of the metering surfaces 104 are repeatedly conducted until the desired rate is attained.

OBJECT AND SUMMARY OF THE INVENTION

An object of the present invention is to provide a fuel injector in which a cross-sectional area of a throttle for determining a fuel flow rate is adjusted easily and correctly.

According to the present invention, a fuel injector comprises, a fuel flow adjustment throttle for determining a flow rate of a fuel passing through the fuel injector, a first member having a cylindrical surface for defining partially the fuel flow adjustment throttle, and a second member including a first surface and a second surface both of which extend toward the first member and join each other at a pointed edge defining the fuel flow adjustment throttle together with the cylindrical surfaces of the first member, and at least one of which forms a space expanding gradually in a fuel flow direction.

Since both of the first and second surfaces extend toward the first member and join each other at the pointed edge defining the fuel flow adjustment throttle together with the first member, a cross-sectional area of the fuel flow adjustment throttle for adjusting the flow rate of the fuel passing through the fuel injector is determined by a clearance between the first member and the pointed edge on the second member so that the cross-sectional area is determined only by a position of the pointed edge or a position of a terminating common end of the first and second surfaces, although in the prior art, the cross-sectional area is determined by an areal clearance between two members so that the cross-sectional area is determined by an areal position of a surface on at least one of the two members, and an adjustment of the areal position of the surface is more difficult than an adjustment of the position of the pointed edge. Therefore, in the present invention, the cross-sectional area of the throttle for determining the fuel flow rate is adjusted easily and correctly.

Further, since at least one of the first and second surfaces forms the space expanding gradually in the fuel flow direction over the first member, an amount of change in the cross-sectional area or the position of the pointed edge relative to the first member in a direction substantially perpendicular to the fuel flow direction caused by a change in position or cutting of another one of the first and second surfaces relative to the second member in the fuel flow direction is smaller than an amount of the change in position or cutting of the another one of the first and second surfaces relative to the second member in the fuel flow direction. Therefore, in the present invention, the cross-sectional area of the throttle for determining the fuel flow rate is adjusted easily and correctly.

DETAILED DESCRIPTION OF THE PREFERRED EMBODIMENT

An embodiment of the fuel injector in accordance with the present invention will be described with reference to the accompanying drawings.

Figure 1:
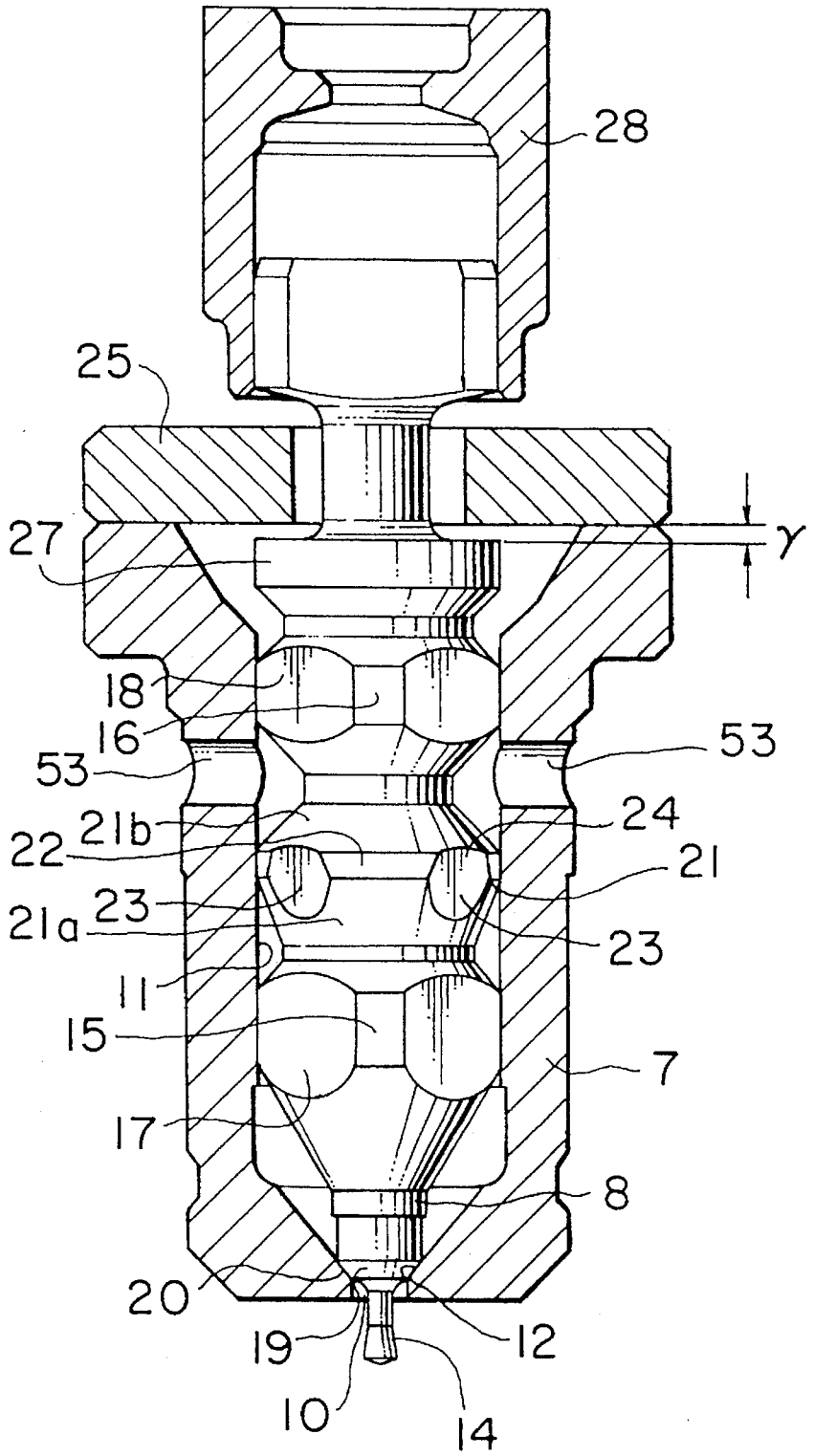
FIG. 1 is a sectional view showing a critical portion of a fuel injector embodying the present invention.
Figure 2:
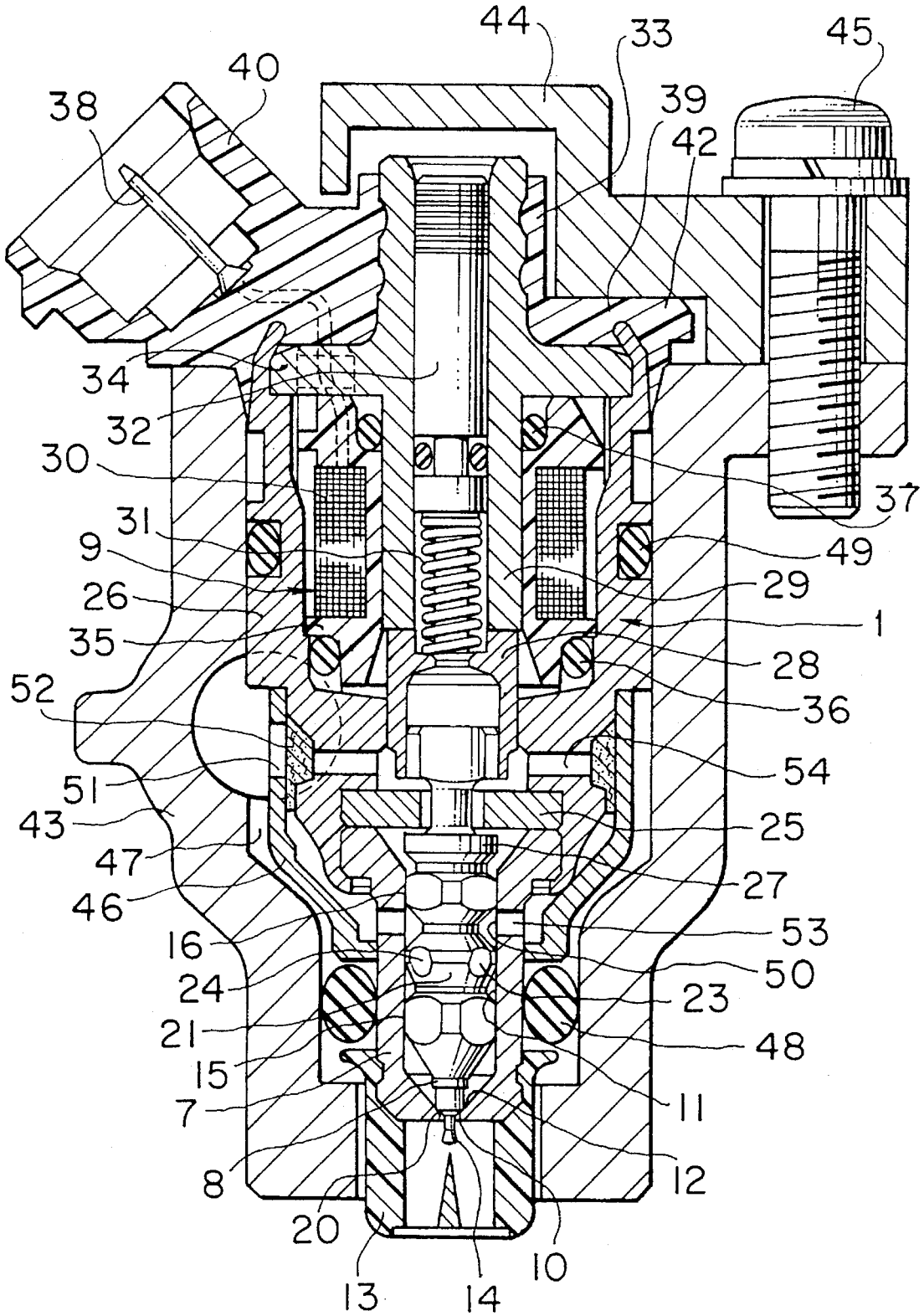
FIG. 2 is a sectional view of a solenoid-type fuel injector embodying the present invention.
Figure 3:
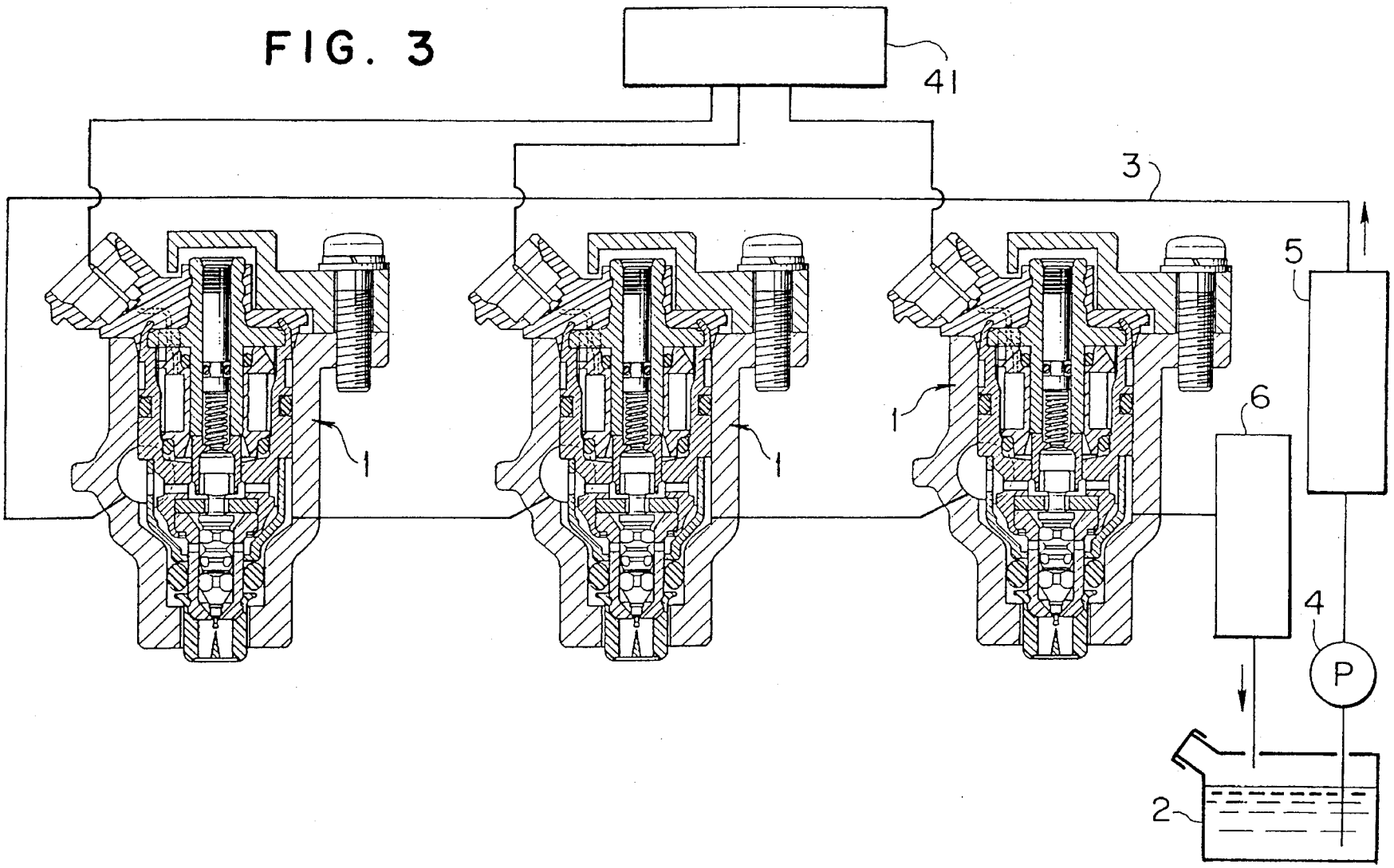
FIG. 3 is a schematic illustration of a fuel supply system of a fuel injector.
Figure 4:
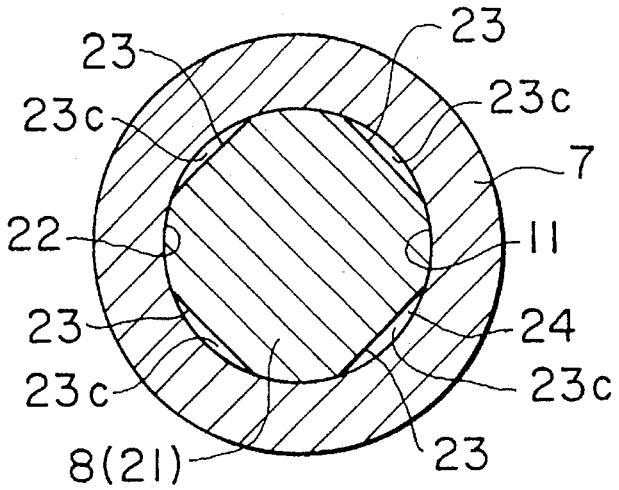
FIG. 4 is a sectional view of a sectional view of a second fuel metering portion composed of a valve case and a valve member in an embodiment of the present invention.

FIGS. 1 to 6 show an embodiment of the present invention. FIG. 2 is a sectional view of a solenoid-type fuel injector, while FIG. 3 is a schematic illustration of a fuel supply system of the fuel injector.

A fuel injector 1 supplies gasoline as the fuel to a combustion chamber of an automotive gasoline engine (not shown), and is mounted on an intake manifold which supplies combustion air, at a portion of the intake manifold near the combustion chamber. More specifically, a plurality of such fuel injectors, corresponding in number to the number of cylinders of the engine, are mounted on the intake manifold. A fuel supply system has a fuel line 3 which leads from a fuel tank 2 to the fuel injectors 1 and then leads back to the fuel tank 2. An electric pump 4, fuel filter 5, fuel injectors 1 corresponding to the respective cylinders and a pressure regulator valve 6 are mounted on and along the fuel line 3 in the mentioned order from the upstream end. The fuel regulator valve 6 has a function to maintain a constant pressure differential between the pressure in the intake pipe and the pressure of the fuel inside the fuel line between the electric pump 4 and the pressure regulator valve 6.

The fuel injector 1 is composed mainly of a valve case 7, a valve member 8 and an electromagnetic actuator 9. As shown in FIG. 1, the valve case 7 has a substantially cylindrical form and is provided at its one end with a nozzle 10 for injecting the metered fuel into the intake pipe. A cylindrical guide bore 11 is formed in the valve case 7. Between the nozzle 10 and the valve case 7, there is provided a valve seat 12 which is formed of a conical surface communicating both with the nozzle 10 and the guide bore 11. A needle-type valve member 8 is disposed inside the guide bore 11. As shown in FIG. 2, a nozzle cover 13 is provided outside the nozzle 10 and the valve case 7. The nozzle cover 13 introduces the fuel injected from the nozzle 10 into the intake pipe.

As shown in FIG. 1, the valve member 8 has a pin 14 which is formed integrally with the valve member 8 at one end of the latter and which projects into the nozzle 10. The extreme end of the pin 14 has a form like an umbrella so as to promote atomization of the fuel jetted from the nozzle 10. Sliding portions 15, 16 are provided on the respective axial ends of the valve member 8. The sliding portions 15, 16 have a radially projecting annular form. The valve member 8 is slidably supported at these guide portions 15, 16 in the guide bore 11 formed in the valve case 7. The sliding portion 15 has four flat portions 17. Similarly, the sliding portion 16 has four flat portions 18. Each flat portion cooperates with the inner peripheral surface of the guide bore 11 in defining a gap through which fuel flows smoothly. The valve member 8 has a contact portion 19 adjacent to the pin 14, the contact portion 19 being adapted to be seated on a valve seat 12 formed in the valve case 7. The valve member 8, after mounted in the fuel injector 1, is movable relative to the valve case 7 between a close position in which the contact portion 19 is seated on the valve seat 12 to close the fuel injection nozzle 10 and an open position in which the contact portion 19 is spaced apart a predetermined distance from the valve seat 12 so as to open the fuel nozzle 10.

When the valve member 8 is in the open position, an annular gap is formed between the valve seat 12 and the contact portion 19. This annular gap forms a fuel metering portion 20 which controls the rate of injection of the fuel.

The valve member 8 also has an annular flange portion 21 projecting radially therefrom at a portion upstream of the contact portion 19 between the sliding portions 15 and 16. The flange 21 provides a cylindrical barrel 22 which slidingly engages with the wall surface of the guide bore 11. A plurality of, e.g., four, metering surfaces 23 are formed on the outer peripheral surface of the flange 21 at an inclination to the axis of the valve member 8. A second metering portion 24 which is one of the features of the invention is formed by the gap between the metering surfaces 23 and the wall surface of the guide bore 11 formed in the valve case 7. As will be seen from FIG. 4, the rate of injection of fuel from the nozzle 10 is controlled by the area of the fuel passage defined between the wall surface of the guide bore 11 and the metering surfaces 23.

Figure 5:
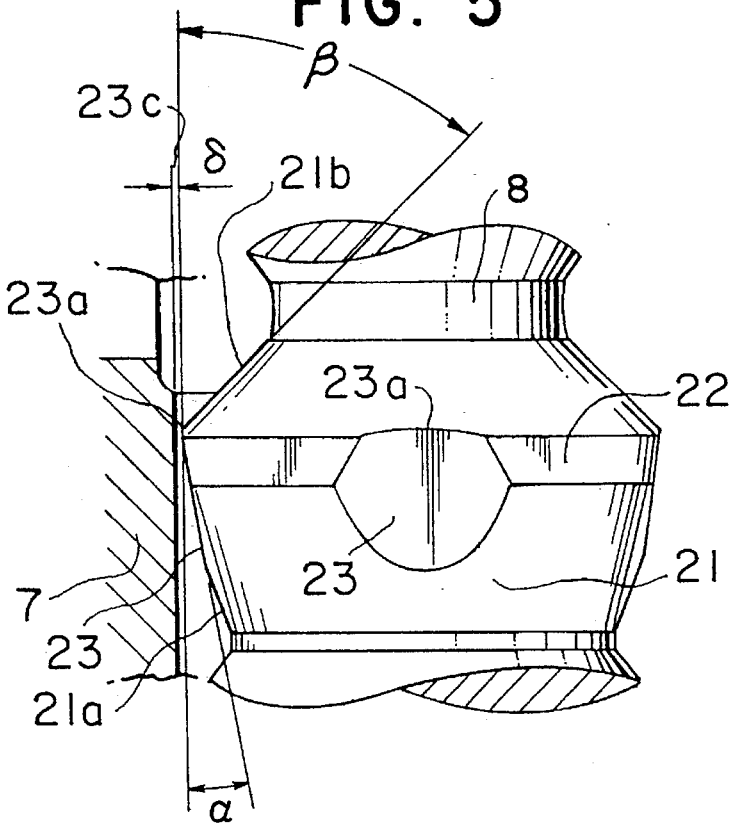
FIG. 5 is a sectional view of a critical portion of the second fuel metering portion.

The metering surface 23 may be flat or curved, provided that it has an inclination $\alpha$, e.g., 2 to 3°, with respect to the axis of the valve member 8, as shown in FIG. 5. That is, the metering surface 23 is tapered with respect to the axis of the valve member 8. The flange 21 has both shoulder surfaces 21*a* and 21*b*. The shoulder surface 21*b*, adjacent to the broader end of the tapered metering Surface 23, provides a surface which is to be cut by machining for increasing the area of the fuel passage of the second metering portion 24, and is conically shaped such that its generating line is inclined at an angle $\beta$, e.g., 45° to the axial direction of the valve member 8, as shown in FIG. 5. The line 23*a* at which the shoulder surface 21*b* and the metering surface 23 merge in each other forms an edge which opposes the wall surface of the bore of the valve case 7, defining a gap 23*c* therebetween. The angles $\alpha$ and $\beta$ are so determined as to meet the condition of $\alpha \leqq \beta$. The second metering portion 24 produces a pressure loss in an amount of 5% or more of the total pressure loss, while the balance is mostly generated across the first metering portion 20. The gap between the wall surface of the nozzle 10 and the pin 14 is large enough to produce a small pressure loss of 5% or less.

The end of the valve member 8 opposite to the pin 14 is received in a bore formed in a ring-shaped stopper. The stopper 25 is clamped between and fixed to a cylindrical casing 26 which surrounds the electromagnetic actuator 9 and adjacent end of the valve case 7. An annular flange 27 is formed on a portion of the valve member 8 adjacent the stopper 25. When the valve member 8 is lifted by the electromagnetic actuator 9, the flange 27 abuts the stopper 25, thus determining the open position of the valve member 8. The distance or stroke travelled by the valve member 8 between the close position and the open position is referred to as "needle life $\gamma$", as indicated in FIG. 1. The end of the valve member 8 opposite to the pin 14 projects into the casing 26 past the stopper 25.

The casing 26 accommodates an electromagnetic actuator 9 which actuates the valve member 8 between the close position and the open position. The electromagnetic actuator 9 is mainly composed of an armature 28, a stator 29 and a solenoid coil 30. The armature 28 is a magnetic member which is connected to the end of the valve member 8 opposite to the pin 14 so as to be displaced in the direction of the axis of the valve member 8 together with the latter. The armature 28 is normally biased downward as viewed in FIG. 1, i.e., towards the valve member 8, by a return spring 31. The stator also is made of a magnetic material and has a cylindrical form. The stator 29 is disposed at the side of the armature 28 opposite to the valve member 8, i.e., at the upper side of the armature 28 as viewed in FIG. 1, coaxially with the armature 28. An adjusting rod 32 for adjusting the urging force of the return spring 31 is inserted into the stator 29, and is thereto being sealed at a sealed portion 33. The stator 29 is provided at its mid portion with a radially extending flange 34. The flange 34 is caulked to the end of the casing 26, thus fixing the stator 29 to the casing 26.

A solenoid coil 30 is wound on a bobbin 35 and is provided on the outer periphery of the stator 29 inside the casing 26. In order to prevent fuel from coming into the solenoid coil 30, "O" rings 36, 37 are mounted on both ends of the solenoid coil 30. The solenoid coil 30 is connected to terminals 38 which are supported in a connector 40 formed by a mold resin 39 on the end of the casing 26. The terminals 38 are connected to an electronic control circuit 41 including a microcomputer. The electronic control circuit 41 conducts control of energization of the solenoid coil 30 of each fuel injector 1 in accordance with the state of operation of the engine. The solenoid coil 30, when excited with electric power under the control of the electronic control circuit 41, generates magnetic force to lift the armature 28 against the force of the return spring 31 upward as viewed in FIG. 1. The mold resin 39 forming the connector 40 is provided with an annular flange 42. The flange 42 is sandwiched between the housing 43 accommodating the fuel injector 1 and a cover 44. The flange housing 43 and the cover 44 are fixed together by means of screws 45 with the flange 42 clamped between the housing 43 and the cover 44, whereby the fuel injector 1 is fixed in the housing 43.

A cover 46 providing a fuel strainer is fitted on the adjacent ends of the valve case 7 and the casing 26. An annular gap 47 is formed between the housing 43 and the cover 46. The housing 43 is provided with a fuel inlet (not shown) through which fuel is introduced into the annular gap 47 and an outlet (not shown) through which the fuel flows out of the annular gap 47. The fuel introduced into the gap 47 through the inlet flows along the gap 47 so as to cool the interior of the fuel injector and then flows out of this gap 47 through the outlet. In order to prevent the fuel from leaking from the annular gap to exterior of the housing 43, "O" rings 48 and 49 are provided between the casing 26 around the solenoid coil 30 and the housing 43 and between the valve case 7 and the housing 43.

A description will now be given of the fuel supply passage 50 through which the fuel is supplied from the annular gap 47 to the fuel injection nozzle 10. The fuel supplied into the annular gap 47 is introduced to the space inside the cover 46 through a mesh filter 52 which is mounted in the opening 51 formed in the cover 46. The fuel is then introduced into the fuel injector 1 through field holes 53 provided in the valve case 7 and purge holes provided in the casing 26. The field holes 53 introduce the fuel into the portion of the guide bore 11 between the flange 21 of the second fuel metering portion 24 and the sliding portion 16 of the valve member 8. A plurality of field holes are radially arranged and formed in the valve case. The purge holes 54 introduce the fuel into the space between the armature 28 and the casing 26, so as to supply the fuel into the guide bore 11 through the clearance between the stopper 25 and the valve member 8.

A description will now be given of the manner in which the adjustment of the fuel injection rate is conducted in the course of manufacture of the fuel injector 1. As the first step, the end of the valve case 7 adjacent the stopper 25 is ground into flat form in such a manner that a predetermined needle lift $\gamma$ is obtained. Then, the fuel injector 1 is assembled after machining to such an extent that permits actual fuel injection and measurement of the injection rate.

Figure 6:
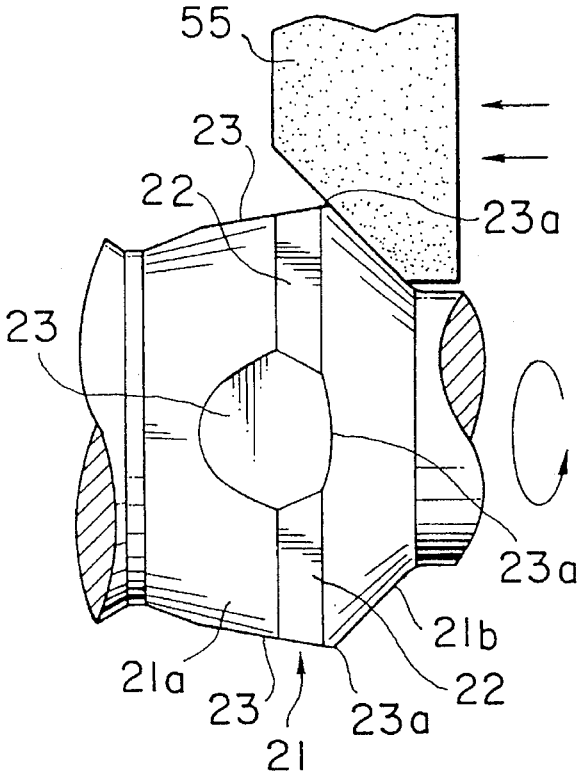
FIG. 6 is an illustration of a manner in which a shoulder surface of a flange is machined.
Figure 7:
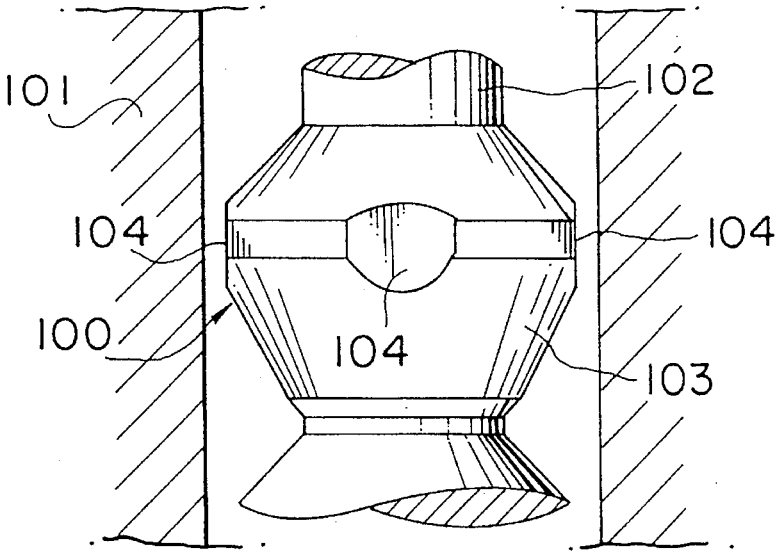
FIG. 7 PRIOR ART
FIG. 7 is a sectional view of a critical portion of a prior art fuel injector.

When the result of measurement is smaller than the required injection rate, the upstream shoulder surface **21*b* of the flange 21 is ground by an abrasive stone 55 while the valve member 8 is rotated about its axis, as shown in FIG. 6. Consequently, the wider ends of all the tapered metering surfaces 23 are ground so that the gap $\delta$ between the metering surface and the wall of the guide bore 11 is increased as shown in FIG. 5. Thus, the distance between the edge line 23*a* and the wall surface of the fuel passage is increased. Thus, the area of the fuel passage on all the metering surfaces 23 is increased. Consequently, the rate of passage of the fuel in the second metering portion 24 and, hence, the rate of injection of the fuel from the injection nozzle 10 increases. Conversely, when the measured fuel injection rate is larger than the required injection rate, a machining is conducted to grind the end of the valve case 7 into flat form. As a result of the grinding of this end of the valve case, the needle lift $\gamma$ is reduced, thus reducing the size of the gap between the valve seat 12 and the contact portion 19 of the valve member 8** in the open position.

Thus, by grinding the shoulder surface **21*b* of the flange 21 and the end surface of the valve case 7**, it is possible to attain the desired rate of injection of fuel from the fuel injector as the product.

As will be understood from the foregoing description, according to the present invention, it is possible to simultaneously increase the areas of the fuel passages on all the fuel metering surfaces 23 of the second metering portion 24, simply by grinding the shoulder surface **21*b* while rotating the valve member 8. Consequently, the adjustment of the fuel injection rate can be conducted in a short time, without requiring any expensive precision position detector which hitherto has been necessary in grinding the metering surfaces 23. It is therefore possible to reduce the cost of production of the fuel injector 1. According to the principles of the invention, the angle $\alpha$ of inclination of the metering surface 23 and the angle $\beta$ of inclination of the shoulder surface 21*b* with respect to the axis of the valve case are determined such as to meet the condition of $\alpha \leqq \beta$. It is therefore possible to machine the second metering portion 24 with a degree of precision higher than that of the machining effected on the shoulder surface 21*b*. Namely, in the described embodiment, the amount of increase in the gap 23*c* is smaller than the amount of grinding of the shoulder surface 21*b*, so that the size of the gap 23*c*** can be delicately controlled.

Distances between the lines (edges) **23*a* and a center axis of the valve member 8** may be constant to be formed simultaneously.

In the illustrated embodiment, the metering surface is shaped in a tapered form which diverges towards the upstream end. This, however, is only illustrative and the tapered metering surface may be formed to diverge towards the down stream end. In such a case, the area of the fuel passage in the second metering portion can be increased by grinding the downstream side shoulder surface.

It is possible to use one of the sliding portions of the valve member as the fuel metering flange, although the fuel metering flange is provided between two sliding portions in the illustrated embodiment. When the upstream sliding portion is used as such flange, the fuel injector should be so constructed that all part of the fuel to be jetted from the fuel injection nozzle is supplied to the upstream side of the upstream sliding portion. Although in the illustrated embodiment a plurality of metering surfaces are formed, it is possible to employ only one such metering surface or the entire circumference of the flange may be conically tapered.

Although the invention has been described through its specific form, it is to be understood that the described embodiment is only illustrative and various changes and modifications may be imparted thereto.

The fuel injector of the invention can be applied to all types of engines which require fuel injection, although a spark ignited gasoline engine is specifically mentioned in the description.

What is claimed is:

1. A fuel injector having a fuel flow adjustment throttle for determining a flow rate of a fuel passing through the fuel injector, comprising:

a first member having a cylindrical surface defining partially the fuel flow adjustment throttle; and a second member including a first surface and a second surface both of which extend toward the cylindrical surface and join each other at a pointed edge which defines the fuel flow adjustment throttle together with the cylindrical surface, wherein the second member has at least two guide surfaces contacting with the cylindrical surface to guide the second member relative to the first member, and the first and second surfaces are arranged between the two guide surfaces.

2. A fuel injector according to claim 1, wherein one of the first surface and the second surface together with the cylindrical surface defines a space expanding gradually from the fuel flow adjustment throttle in a fuel flow direction.

3. A fuel injector according to claim 1, wherein one of the first surface and the second surface together with the cylindrical surface defines a space contracting gradually toward the fuel flow adjustment throttle in a fuel flow direction.

4. A fuel injector according to claim 1, wherein an opening area of the fuel flow adjustment throttle is increased by a shift of a position of at least one of the first and second surfaces.

5. A fuel injector according to claim 1, wherein an opening area of the fuel flow adjustment throttle is increased by axially shifting a position of at least one of the first and second surfaces.

6. A fuel injector according to claim 1, wherein an opening area of the fuel flow adjustment throttle is increased by a shift of a position of one of the first and second surfaces, and an angle between the first member and the other one of the first and second surfaces.

7. A fuel injector according to claim 6, wherein an angle between the first member and one of the first and second surfaces and an angle between the first member and another one of the first and second surfaces are less than right angles.

8. A fuel injector according to claim 1, wherein the second member has a third surface which extends along the first member to reduce the fuel flow between the first member and the third surface and is arranged proximate to one of the first and second surfaces.

9. A fuel injector according to claim 1, wherein a pressure loss through the fuel flow adjustment throttle is more than 5 percent of a pressure loss through the fuel injector.

10. A fuel injector comprising:

a fuel injection nozzle through which fuel is injected;

a valve means for preventing and allowing fuel injection at an upstream side of the fuel injection nozzle; and a fuel flow rate adjusting means arranged at an upstream side of the valve means, wherein the fuel flow rate adjusting means comprises:

a first member having a cylindrical surface defining partially a fuel flow adjustment throttle at the upstream side of the valve means; and a second member having a flange extending toward the cylindrical surface so that the flange and the cylindrical surface together define the fuel flow adjustment throttle, the flange having a conical surface extending toward the cylindrical surface and a metering surface extending obliquely to the cylindrical surface at an opposite side of the conical surface and joining the conical surface to form an edge facing the cylindrical surface so that a gap is formed between the edge and the cylindrical surface, wherein the metering surface and the conical surface extend away from the cylindrical surface beginning at the edge and an angle between the metering surface and the cylindrical surface is smaller than an angle between the conical surface and the cylindrical surface, and wherein the second member has at least two guide surfaces contacting with the cylindrical surface to guide the second member relative to the first member, the conical surface and the metering surface being arranged between the two guide surfaces.

11. A fuel injector according to claim 10, wherein the flange has a plurality of the metering surfaces circumferentially separated from each other.

12. A fuel injector according to claim 10, wherein the cylindrical surface and the fuel injection nozzle are defined by a valve case.

13. A fuel injector according to claim 10, wherein an angle between the conical surface and the cylindrical surface and an angle between the metering surface and the cylindrical surface are not larger than a right angle.

14. A fuel injector according to claim 10, wherein a pressure loss through the gap is not less than 5 percent of a pressure loss through the fuel injector.

15. A fuel injector comprising:

a fuel injection nozzle through which fuel is injected;

a valve means for preventing and allowing fuel injection at an upstream side of the fuel injection nozzle; and a fuel flow rate adjusting means arranged at an upstream side of the valve means, wherein the fuel flow rate adjusting means comprises:

a first member having a cylindrical surface defining partially a fuel flow adjustment throttle at the upstream side of the valve means;

a second member having a flange extending toward the cylindrical surface so that the flange and the cylindrical surface together define the fuel flow adjustment throttle, the flange having a conical surface extending toward the cylindrical surface, and a metering surface extending obliquely to the cylindrical surface at an opposite side of the conical surface and joining the conical surface to form an edge facing the cylindrical surface so that a gap is formed between the edge and the cylindrical surface, wherein an angle between the metering surface and the cylindrical surface is smaller than an angle between the conical surface and the cylindrical surface, and wherein the second member has at least two guide surfaces contacting with the cylindrical surface to guide the second member relative to the first member, the conical surface and the metering surface being arranged between the two guide surfaces; and a cylindrical barrel extending substantially parallel to the cylindrical surface from an outer periphery of the conical surface, and the metering surface is planar.

* * * * *